US008348222B2

(12) United States Patent
Lin

(10) Patent No.: US 8,348,222 B2
(45) Date of Patent: Jan. 8, 2013

(54) FASTENER DEVICE FOR SECURING SPACED MOLD BOARDS

(76) Inventor: Li Mei Lin, Taichung Hsien (TW)

( * ) Notice: Subject to any disclaimer, the term of this patent is extended or adjusted under 35 U.S.C. 154(b) by 155 days.

(21) Appl. No.: 12/927,473

(22) Filed: Nov. 16, 2010

(65) Prior Publication Data

US 2011/0272556 A1 Nov. 10, 2011

(51) Int. Cl.
*E04G 11/08* (2006.01)
*E04G 17/065* (2006.01)

(52) U.S. Cl. ..... 249/42; 249/216

(58) Field of Classification Search ..... 249/42, 249/43, 216
See application file for complete search history.

(56) References Cited

U.S. PATENT DOCUMENTS

| | | | | | |
|---|---|---|---|---|---|
| 915,995 | A | * | 3/1909 | McCarty | 249/10 |
| 1,176,255 | A | * | 3/1916 | Spaulding | 249/20 |
| 1,214,829 | A | * | 2/1917 | Ross | 249/42 |
| 1,586,991 | A | * | 6/1926 | Hawley, Jr. | 264/33 |
| 1,682,740 | A | * | 9/1928 | Colt | 249/42 |
| 1,723,631 | A | * | 8/1929 | Pollock et al. | 249/42 |
| 2,281,833 | A | * | 5/1942 | De Canio | 249/217 |
| 2,620,542 | A | * | 12/1952 | Fontaine | 249/40 |
| 2,887,757 | A | * | 5/1959 | Miles | 52/699 |
| 2,977,659 | A | * | 4/1961 | Buxton | 249/41 |
| 3,405,904 | A | * | 10/1968 | Williams | 249/40 |
| 3,514,070 | A | * | 5/1970 | McArdle | 249/207 |
| 3,618,887 | A | * | 11/1971 | Eriksson | 249/10 |
| 3,667,720 | A | * | 6/1972 | Williams | 249/213 |
| 3,830,461 | A | * | 8/1974 | Williams | 249/213 |
| 3,841,600 | A | * | 10/1974 | Aubee, Jr. | 249/213 |
| 4,033,081 | A | | 7/1977 | Perkins, Jr. | |
| 4,044,986 | A | * | 8/1977 | Strickland et al. | 249/216 |
| 4,186,906 | A | * | 2/1980 | Koga | 249/41 |
| 4,192,481 | A | * | 3/1980 | Durbin | 249/42 |
| 4,231,541 | A | * | 11/1980 | Strickland | 249/216 |
| 4,393,635 | A | * | 7/1983 | Long | 52/309.11 |
| 4,527,768 | A | * | 7/1985 | Cohen | 249/214 |
| 5,097,644 | A | | 3/1992 | Hun | |
| 5,709,058 | A | | 1/1998 | Shaw | |
| 2005/0108985 | A1 | * | 5/2005 | Bravinski | 249/40 |

* cited by examiner

*Primary Examiner* — Michael Safavi
(74) *Attorney, Agent, or Firm* — Charles E. Baxley

(57) ABSTRACT

A wall construction includes two mold boards spaced from each other for forming a chamber between the mold boards, a connection rod disposed between the mold boards, two connecting members attached to the connection rod and engaged through the mold boards and engaged with the mold boards for positioning the mold boards in place relative to each other, and two bracing members attached to the outer ends of the connecting members and engaged with the mold boards for further positioning the mold boards in place relative to each other, two frame members are engaged with the mold boards and secured to the mold boards with lock members.

8 Claims, 13 Drawing Sheets

FASTENER DEVICE FOR SECURING SPACED MOLD BOARDS

BACKGROUND OF THE INVENTION

1. Field of the Invention

The present invention relates to a wall construction, and more particularly to a wall construction including a fastener device for easily and solidly securing mold boards together and for stably forming a concrete wall member without damaging the fastener device.

2. Description of the Prior Art

Typical wall constructions or modular building systems comprise one or more building blocks and one or more frame members having a hollow structure for receiving or filling inserts therein, and accessory mounting and interconnection hardware members for mounting or securing or coupling the building blocks and the frame members together.

For example, U.S. Pat. No. 4,033,081 to Perkins, Jr. discloses one of the typical modular building systems comprising a number of modular building blocks cooperating with the basic structure frame members, such as joist brackets, foundation pedestals, roof panels, floor panels, and accessory mounting and interconnection hardware members for constructing modular buildings or wall members.

However, the typical modular building systems comprises a complicated structure having a number of modular building blocks and frame members required to be manufactured separately and required to be secured together with the accessory mounting and interconnection hardware members such that the construction or manufacturing cost and procedures for the typical modular building systems are greatly increased.

U.S. Pat. No. 5,097,644 to Hun discloses another typical mold board construction comprising a mold body made of concrete and a number of steel wires embedded in the mold body, and a number of mold board constructions having a hollow space for receiving an amount of concrete.

However, similarly, the typical mold board construction comprises a complicated structure having a greatly increased manufacturing cost and procedures.

U.S. Pat. No. 5,709,058 to Shaw discloses a further typical wall construction system comprising a construction unit mounted to standard woodframe support walls formed from studs extending between a header and footer, and a covering unit in the form of ceramic tiles for forming a finishing layer on the support frame work.

However, similarly, the typical wall construction system may only be used to support the covering unit, but not be used to construct a solid wall member.

The present invention has arisen to mitigate and/or obviate the afore-described disadvantages of the conventional wall constructions.

SUMMARY OF THE INVENTION

The primary objective of the present invention is to provide a wall construction including a fastener device for easily and solidly securing mold boards together and for stably forming a concrete wall member without damaging the fastener device.

In accordance with one aspect of the invention, there is provided a wall construction comprising two mold boards spaced from each other for forming a chamber between the mold boards and for filling or inserting or introducing an insert or concrete material into the chamber that is formed or defined between the mold boards, a connection rod disposed between the mold boards and including two end portions, two connecting members each including a first end attached to the end portions of the connection rod and engaged through the mold boards respectively, and the connecting members being engaged with the mold boards respectively for spacing the mold boards from each other and for positioning the mold boards in place relative to each other, and the connecting members each including a second end, and two bracing members attached to the second ends of the connecting members respectively and engaged with the mold boards respectively for further positioning the mold boards in place relative to each other.

Two frame members may further be provided and engaged with the mold boards respectively, the bracing members are engaged through the frame members and each include a lock member attached onto the bracing members and engaged with the frame members for positioning the frame members to the mold boards respectively.

The bracing members each include a lock nut engaged with the lock members for positioning the lock members and the frame members to the mold boards respectively. The bracing members each include an engaging member provided thereon for being rotated relative to the connecting members by the other driving tools.

The connecting members each include an outer thread formed on the second end of the connecting member, and the bracing members each include an inner thread formed in a first end portion thereof for threading and engaging with the outer thread of the connecting members and for securing to the connecting members respectively.

The connecting members each include a non-circular engaging member provided thereon for being rotated relative to the connection rod. The connection rod includes an outer thread formed on each of the end portions thereof, and the connecting members each include an inner thread formed in the first end thereof for threading and engaging with the outer thread of the connecting rod and for solidly and detachably attaching or mounting or securing the connecting members to the end portions of the connection rod respectively.

The connecting members each include a peripheral flange extended radially and outwardly therefrom for contacting and engaging with the mold boards respectively. The peripheral flanges of the connecting members each include an inclined outer peripheral portion.

The connecting members each include an engaging element formed in the second end of the connecting member for allowing the connecting members to be rotated or driven by the other driving tool members, and for allowing the connecting members to be rotated or threaded onto the connection rod respectively, and for allowing the connecting members to be unthreaded or removed or disengaged from the hardened concrete material of the wall member when required.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
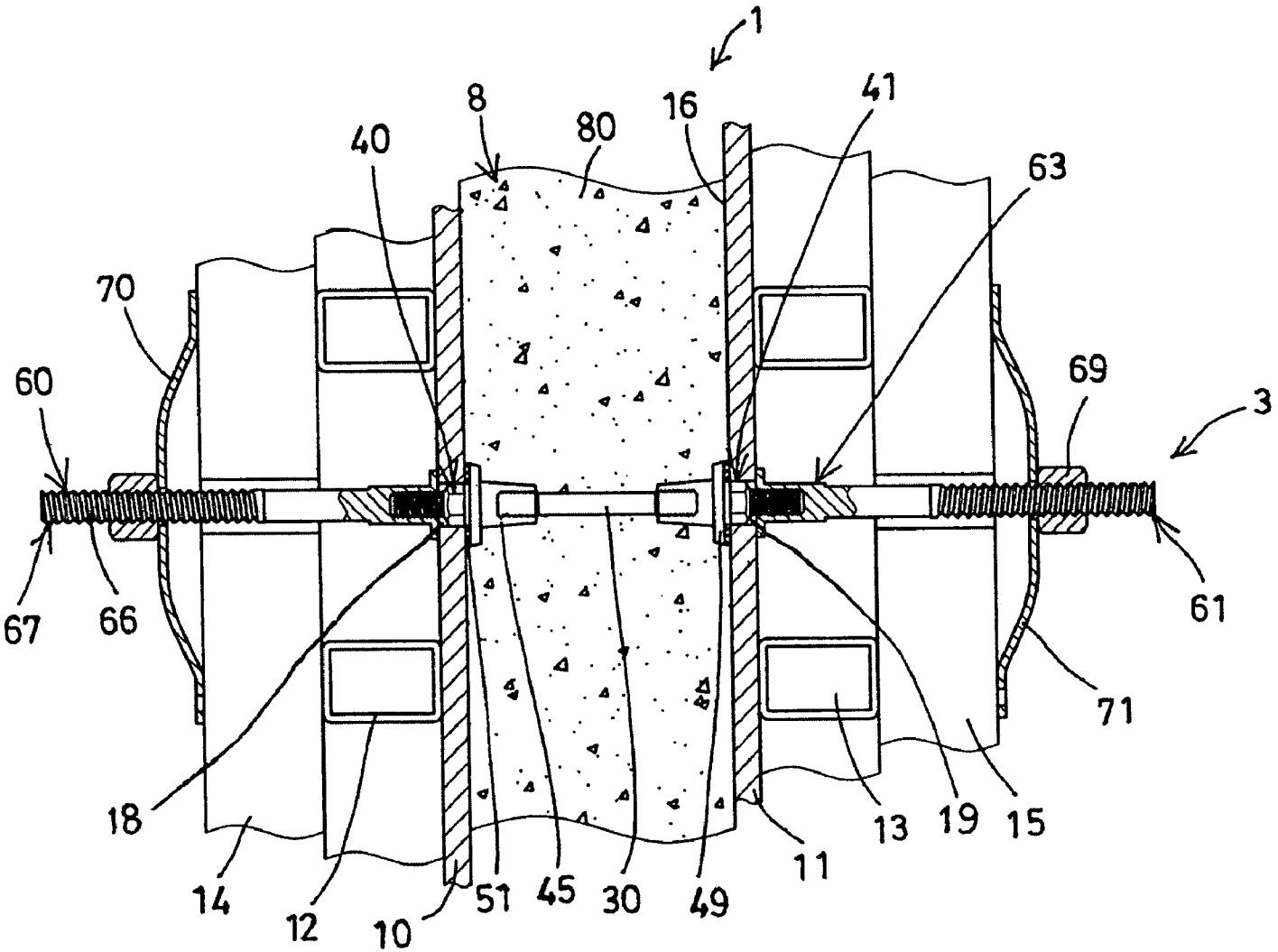
FIG. 1 is a partial cross sectional view of a wall construction in accordance with the present invention.
Figure 2:
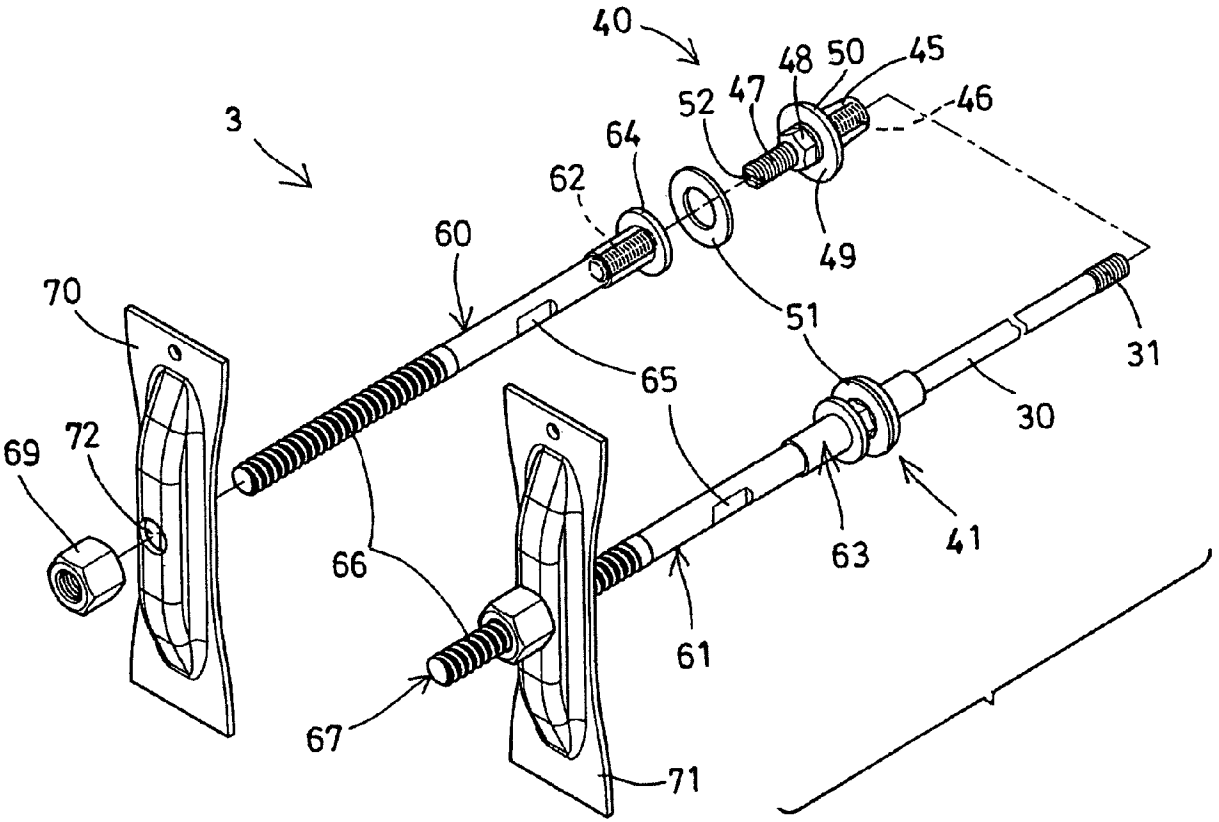
FIG. 2 is an exploded view illustrating the interconnection hardware or fastener device for the wall construction.
Figure 3:
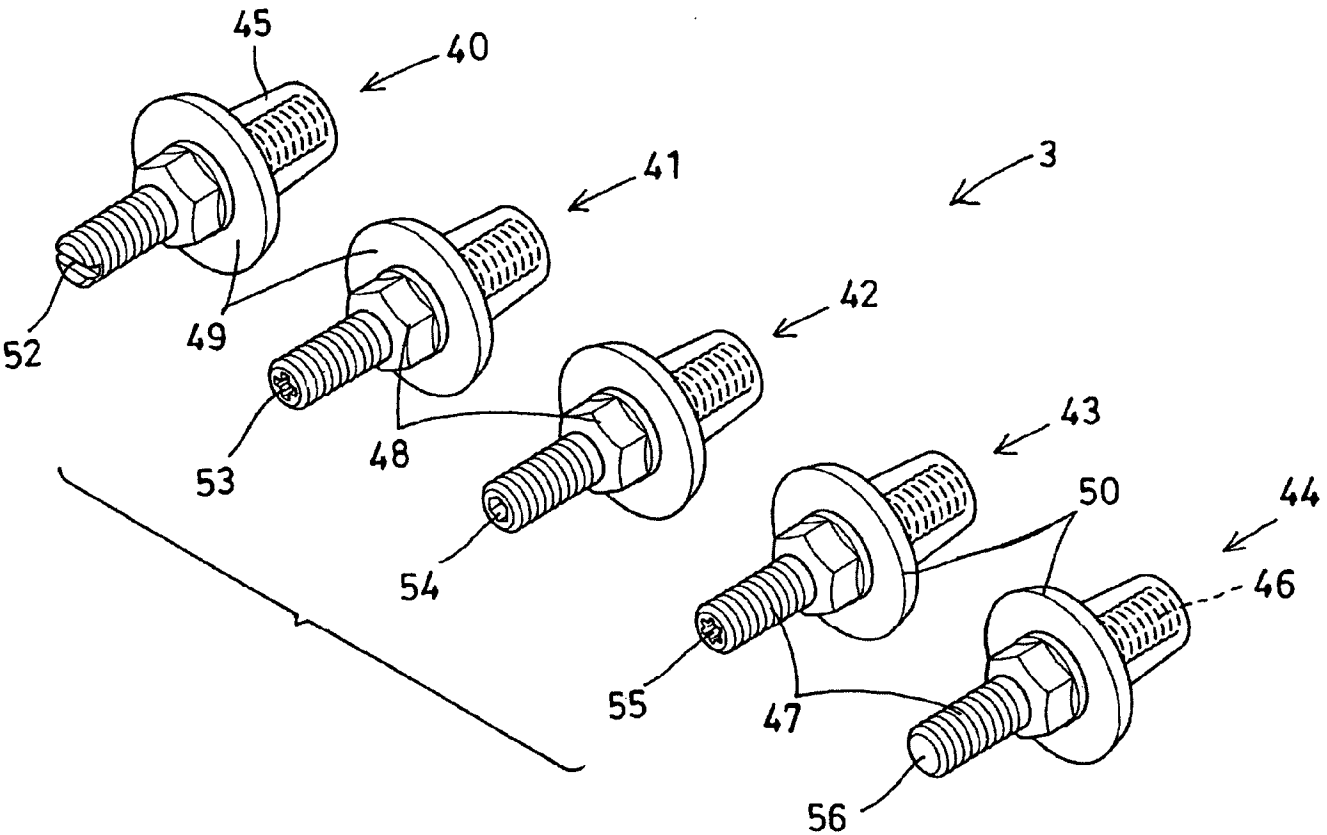
FIG. 3 is another partial exploded view of the interconnection hardware or fastener device for the wall construction.
Figure 4:
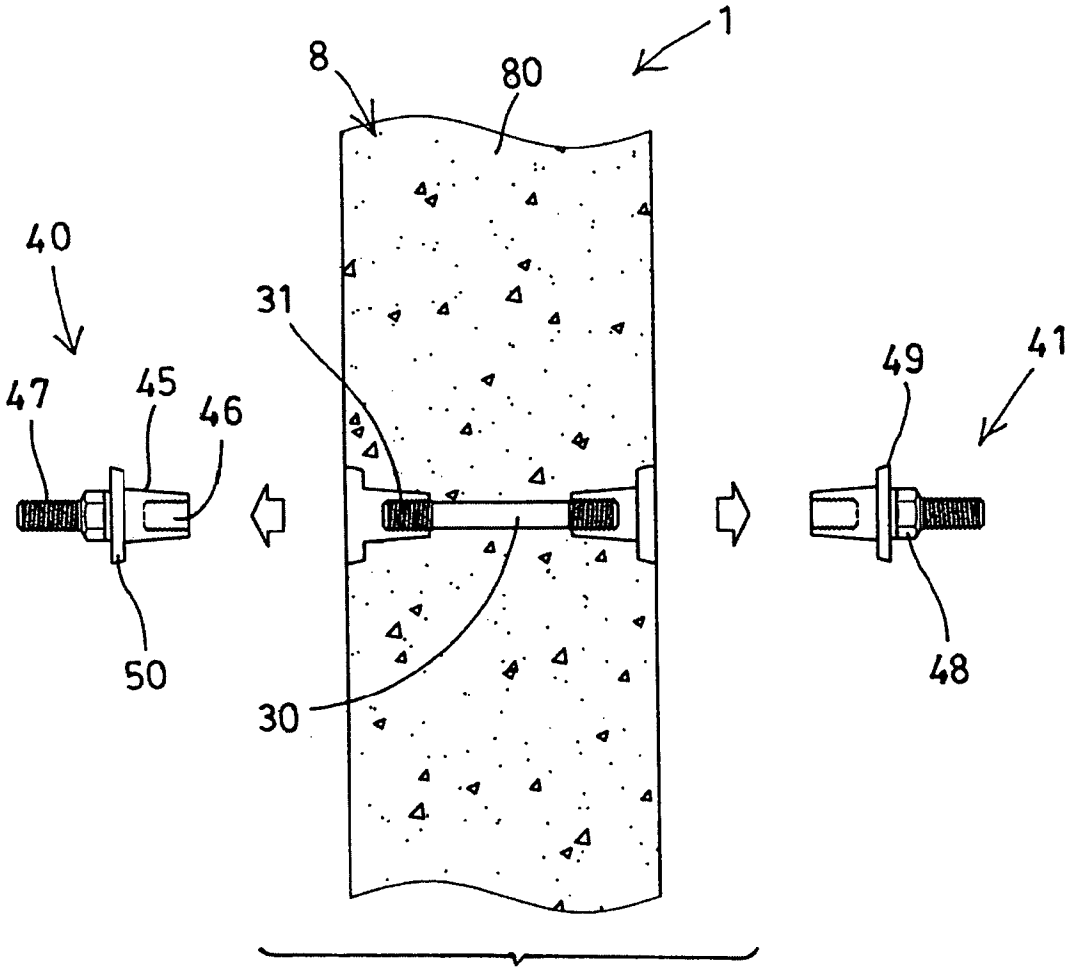
FIG. 4 is a further partial exploded and partial cross sectional view illustrating the operation of the wall construction.
Figure 5:
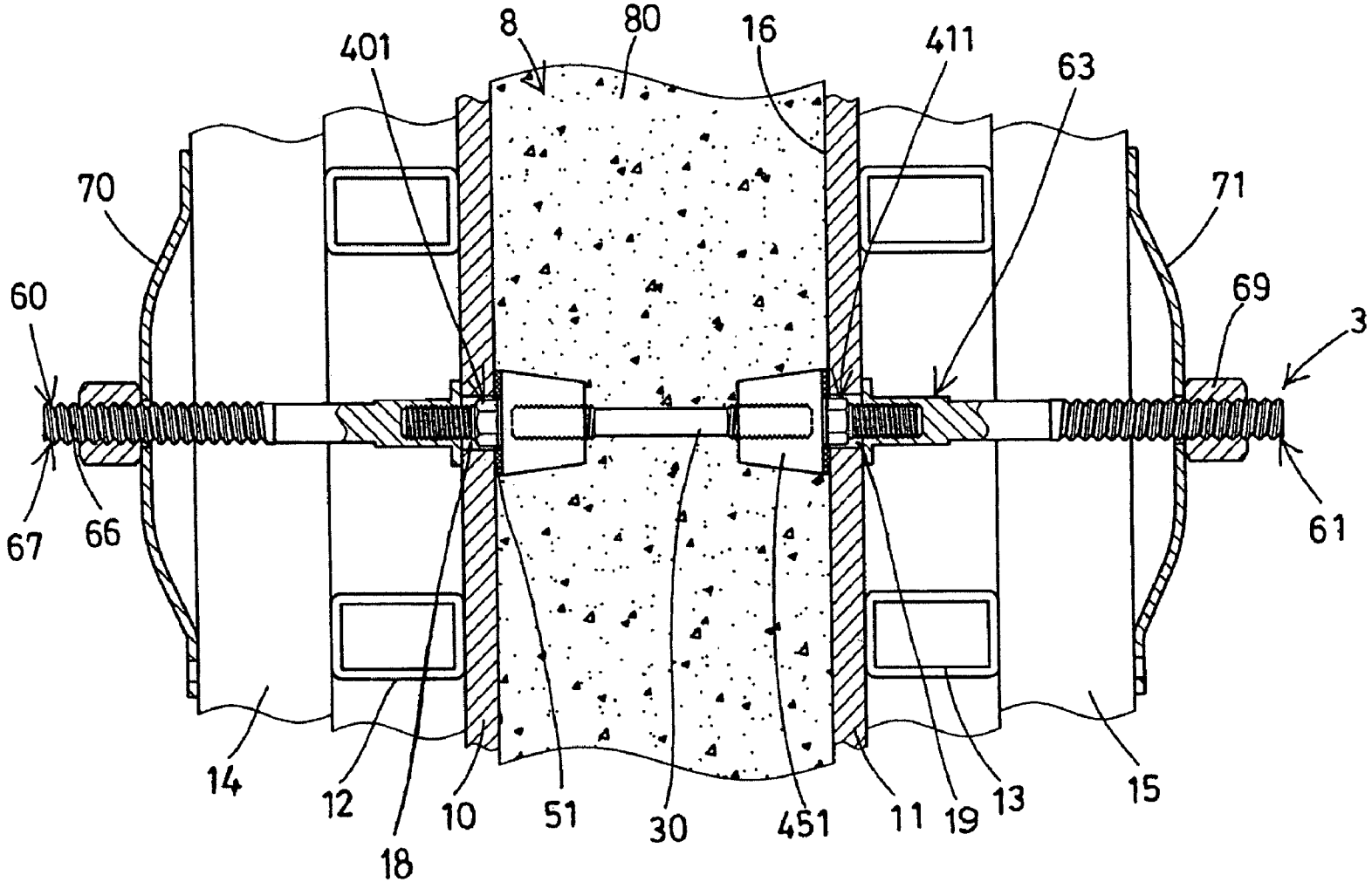
FIG. 5 is a partial cross sectional view similar to FIG. 1, illustrating the other arrangement of the wall construction.
Figure 6:
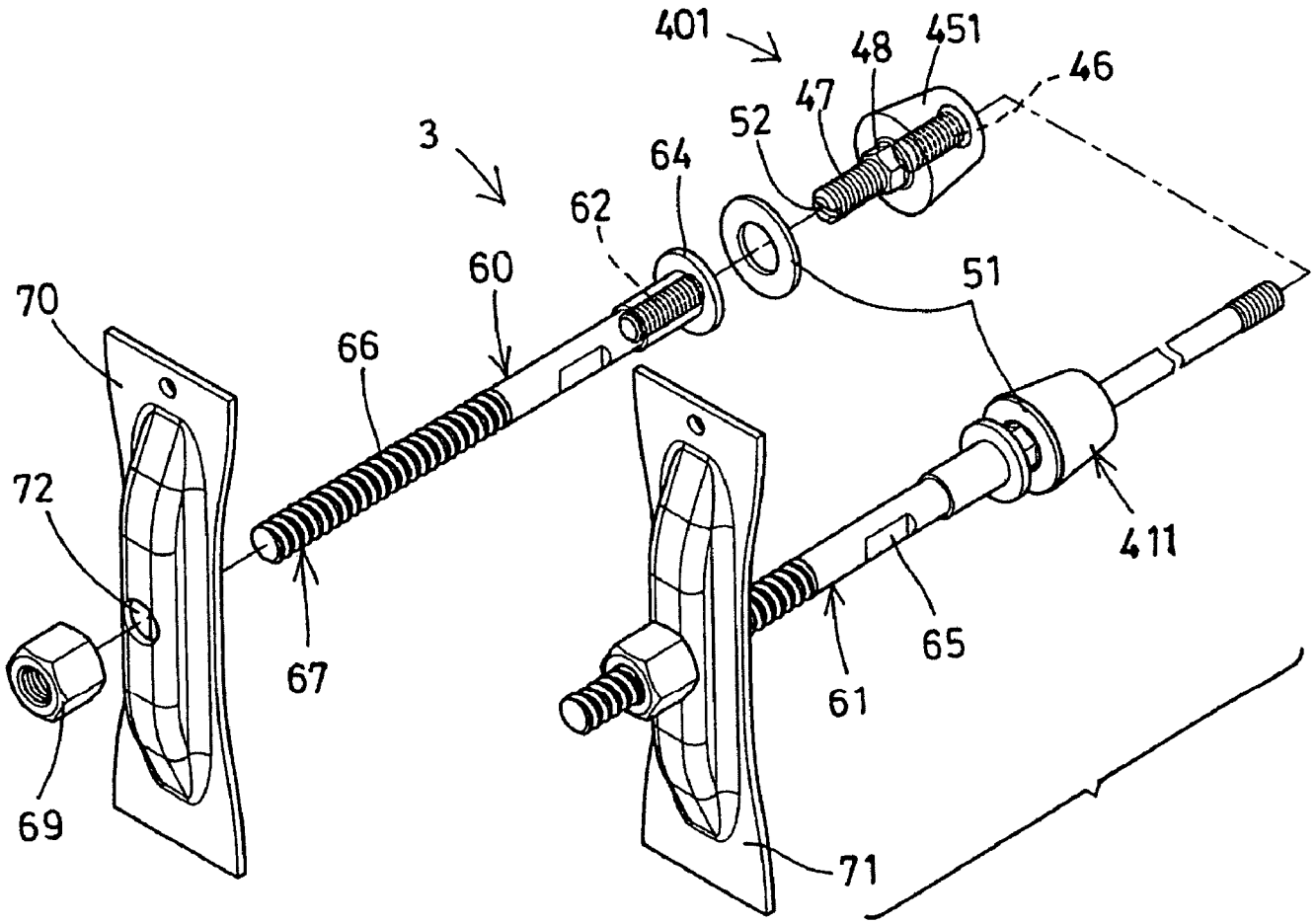
FIG. 6 is an exploded view illustrating the interconnection hardware or fastener device for the wall construction as shown in FIG. 5.
Figure 7:
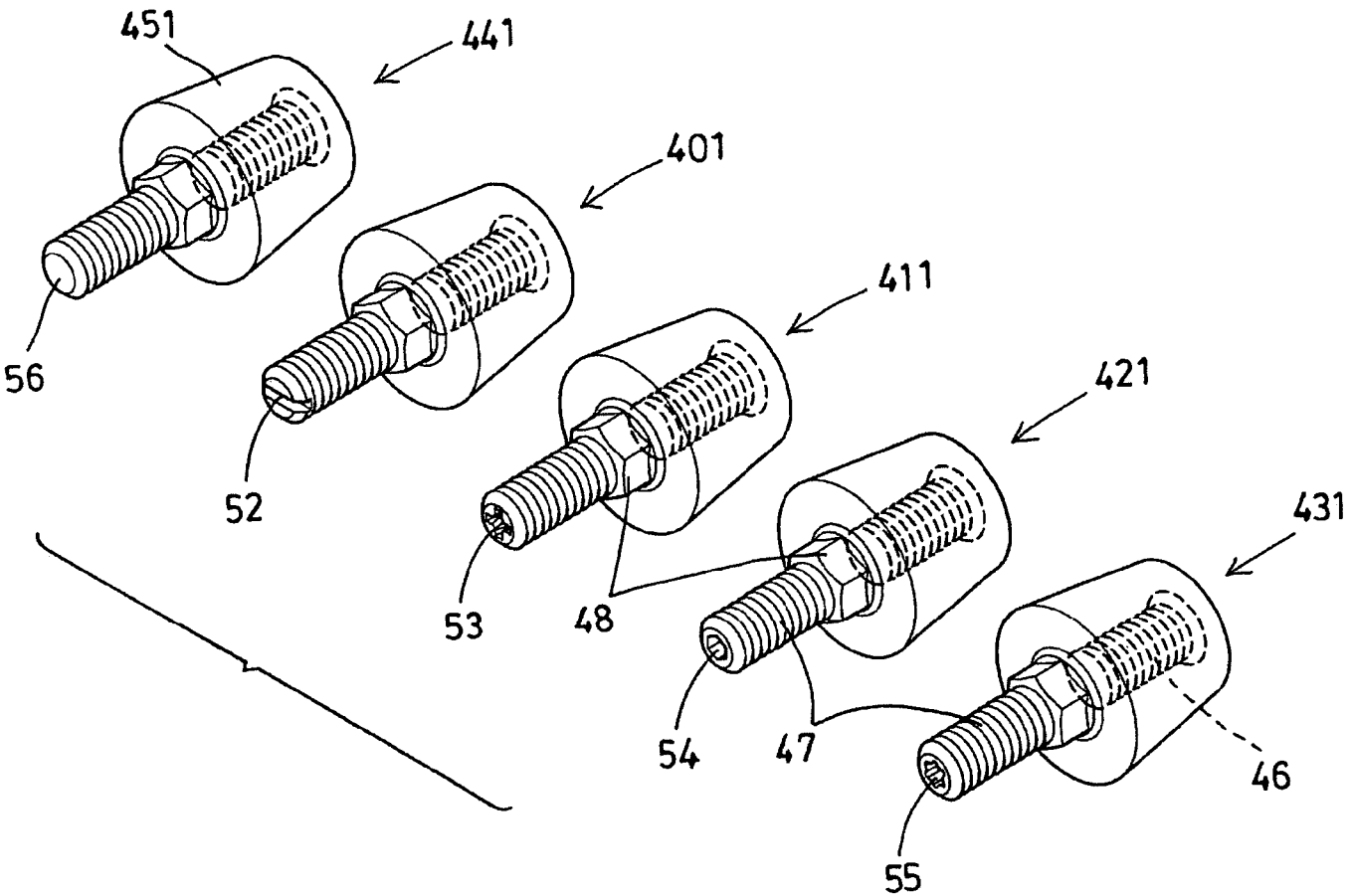
FIG. 7 is a further partial exploded view of the interconnection hardware or fastener device as shown in FIGS. 5-6.
Figure 8:
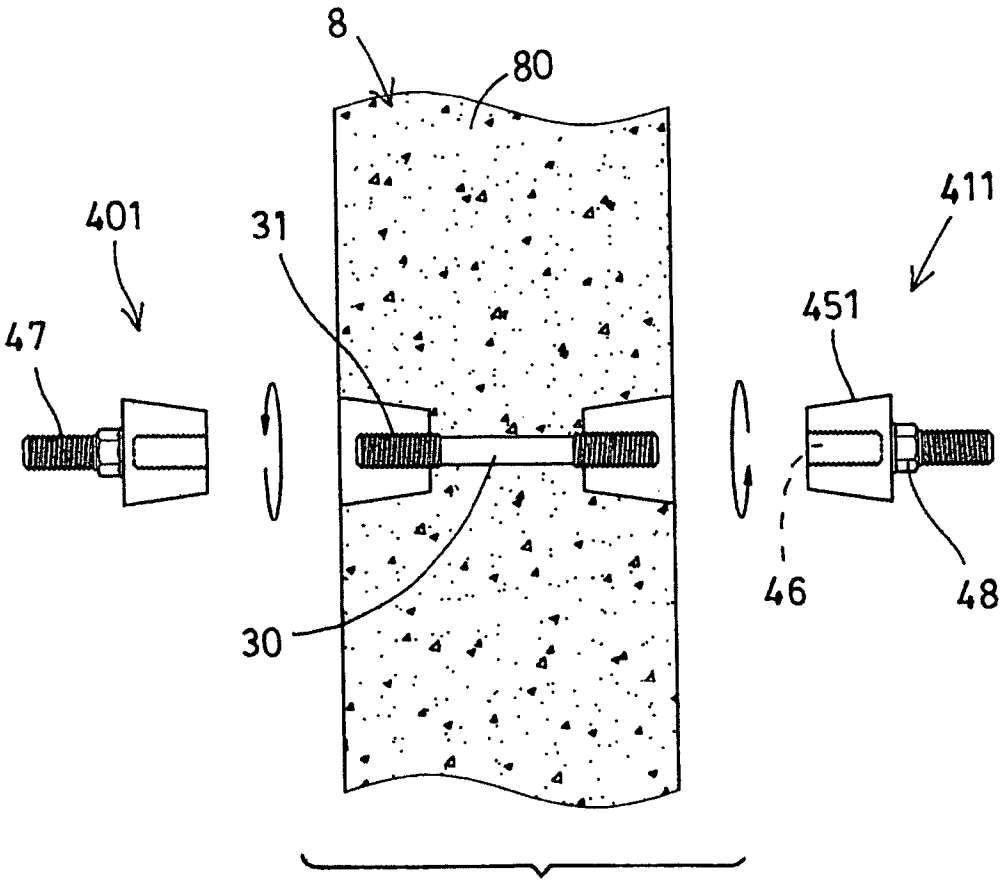
FIG. 8 is a further partial exploded and partial cross sectional view illustrating the operation of the wall construction as shown in FIGS. 5-7.
Figure 9:
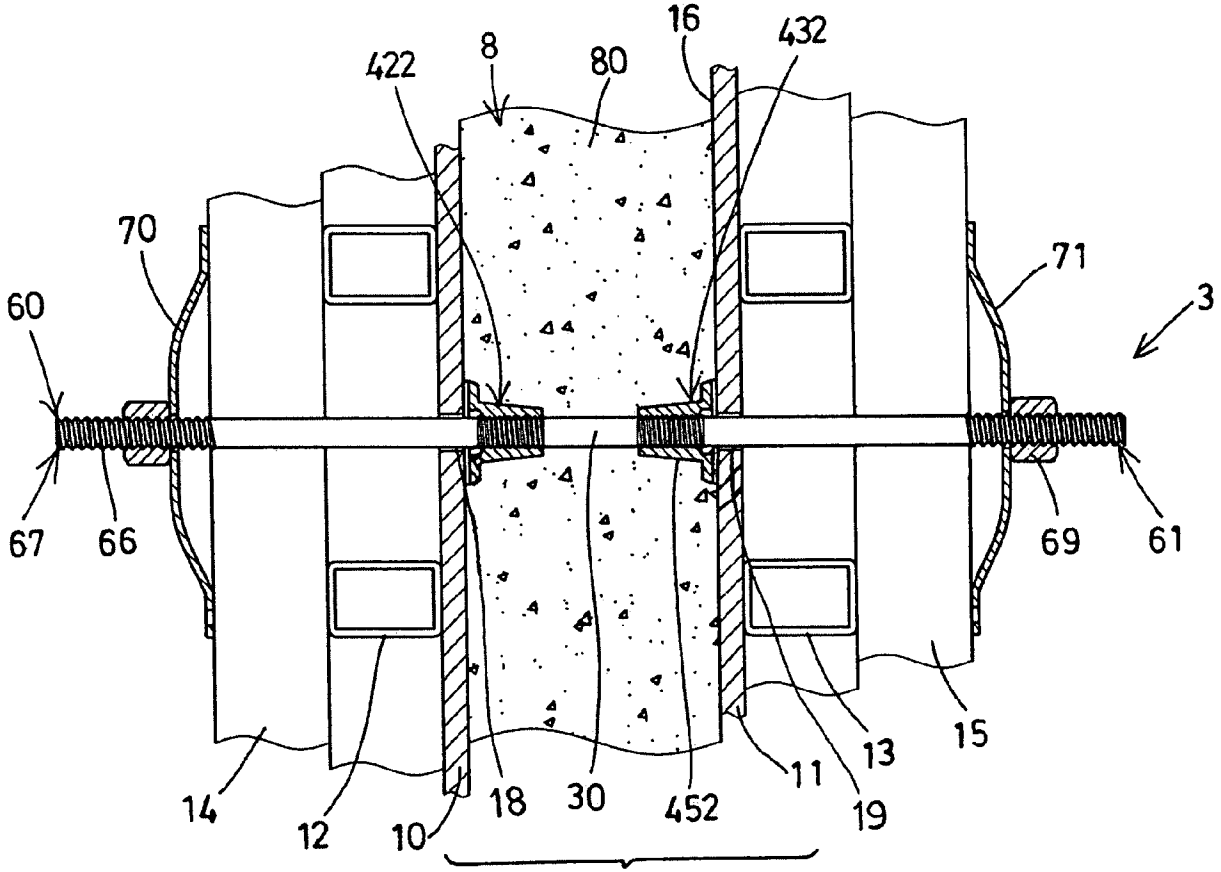
FIG. 9 is a further partial cross sectional view similar to FIGS. 1 and 5, illustrating the further arrangement of the wall construction.
Figure 10:
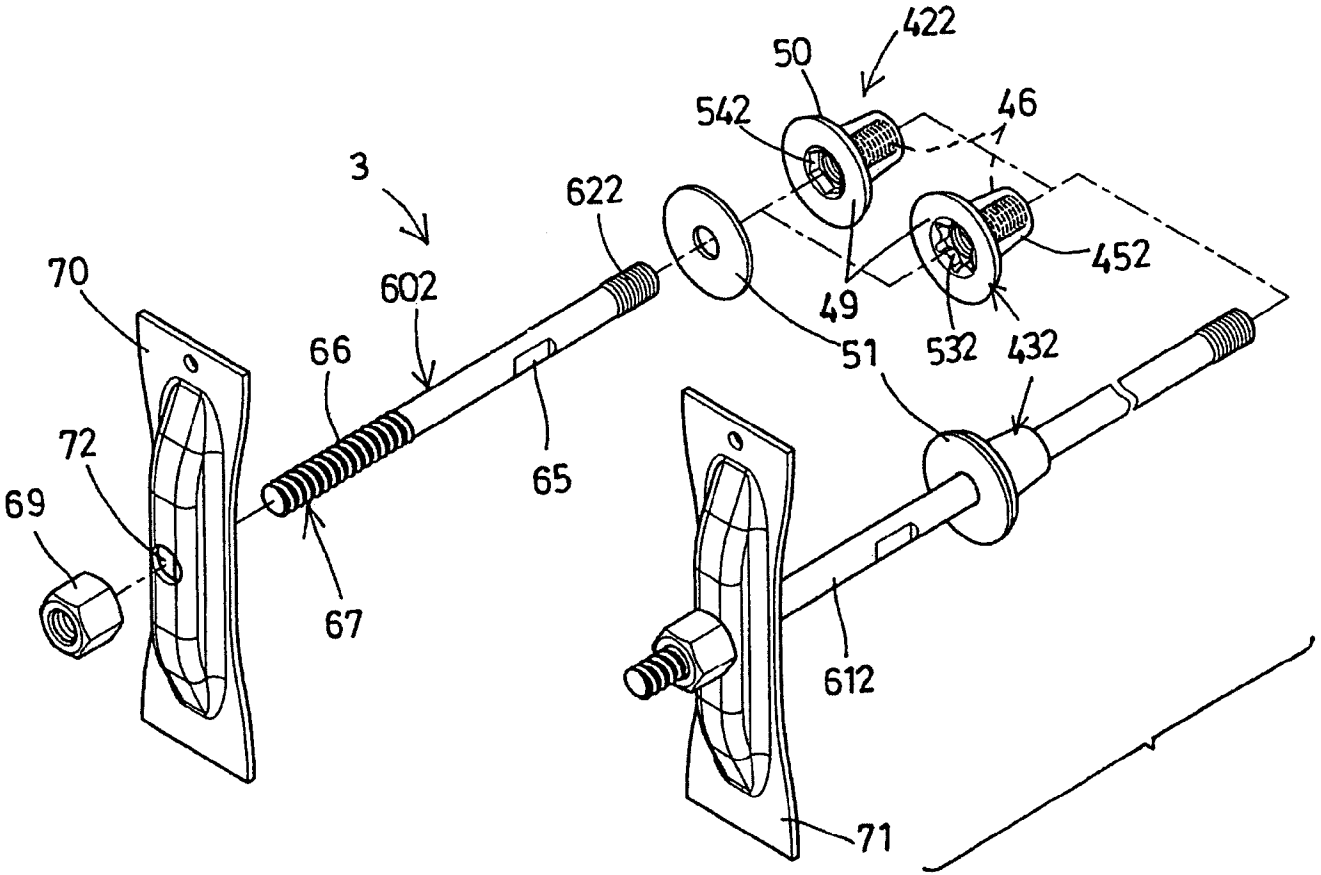
FIG. 10 is an exploded view illustrating the interconnection hardware or fastener device for the wall construction as shown in FIG. 9.
Figure 11:
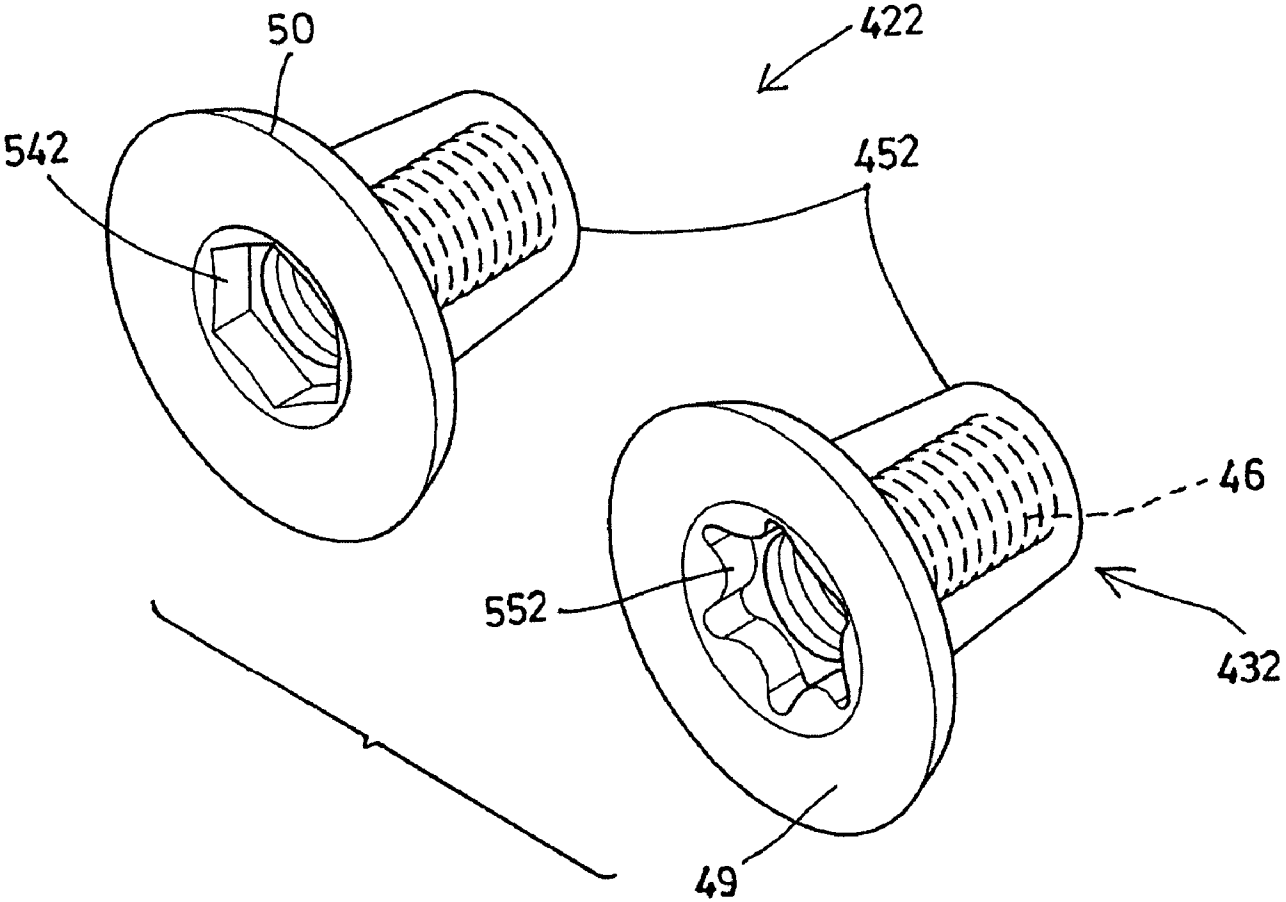
FIG. 11 is a further partial exploded view of the interconnection hardware or fastener device as shown in FIGS. 9-10.
Figure 12:
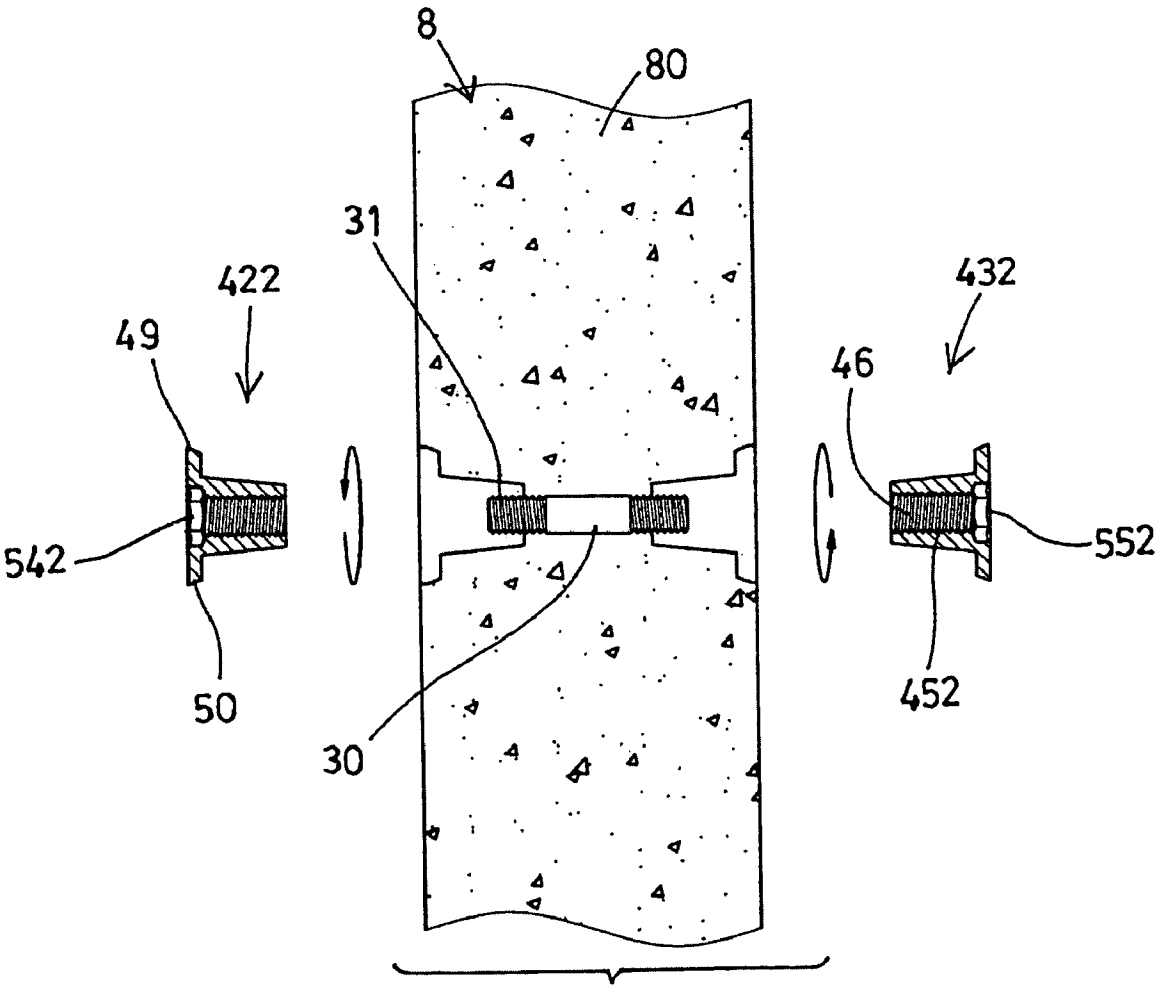
FIG. 12 is a further partial exploded and partial cross sectional view illustrating the operation of the wall construction as shown in FIGS. 9-11.

Referring to the drawings, and initially to FIGS. 1-3, a wall construction 1 in accordance with the present invention comprises two mold boards 10, 11 spaced from each other, and one or more (such as two) pairs of frame or angle members 12, 13; 14, 15 to be secured together with an accessory mounting and interconnection hardware or fastener device 3, for forming or defining a space or chamber 16 between the mold boards 10, 11, and for receiving or filling an insert material or concrete material 80 in the chamber 16 that is formed or defined between the mold boards 10, 11, and for forming a concrete wall member 8 or the like (FIG. 4) after the mold boards 10, 11 and/or the frame or angle members 12, 13; 14, 15 are removed or disengaged from the hardened concrete material 80, in which the frame or angle members 12, 13; 14, 15 may be optionally or selectively provided and are not required in some circumstances, for example.

The fastener device 3 includes a center or middle or intermediate connection rod 30 having two end portions or end outer threads or threaded portions or segments 31, and the connection rod 30 is to be disposed between the mold board 10, 11 and to be engaged in the concrete material 80 (FIGS. 1, 4) that is provided for forming the concrete wall member 8 or the like, two coupling or connecting members 40, 41, 42, 43, 44 are to be attached or mounted or secured to the end portions or threaded end segments 31 of the connection rod 30, and engaged through the openings 18, 19 of the mold boards 10, 11 respectively, and each include one tilted or inclined end 45 having a screw hole or inner thread 46 formed therein for threading or engaging with or attaching to the threaded end segments 31 of the connection rod 30 and for solidly and detachably attaching or mounting or securing to the end portions of the connection rod 30 respectively. The tilted or inclined ends 45 of the connecting members 40-44 are arranged, to allow the connecting members 40-44 to be easily and suitably removed or disengaged from the concrete material 80 of the wall member 8.

The connecting members 40-44 each further include another end having an outer thread formed thereon or a threaded end segment 47, a non-circular engaging member 48 formed or provided on each connecting member 40-44 for allowing the connecting members 40-44 to be rotated relative to the connection rod 30 and to be rotated or driven by various driving tools (not shown), and a peripheral flange 49 extended radially and outwardly from each end 45 of each connecting member 40-44 and having an outer diameter greater than that of the connecting member 40-44 for contacting or engaging with the mold boards 10, 11 (FIG. 1), and for suitably spacing the mold boards 10, 11 from each other and for suitably positioning the mold boards 10, 11 in place relative to each other and for suitably blocking or sealing the openings 18, 19 of the mold boards 10, 11 respectively. The ends 45 of the connecting members 40-44 may also be directly engaged with the mold boards 10, 11 without the flange 49. It is preferable, but not necessarily that the connecting members 40-44 each include an inclined or tilted outer peripheral portion 50 formed on the outer peripheral portion of the peripheral flange 49 thereof for allowing the connecting members 40-44 to be easily and suitably rotated and removed or disengaged from the concrete material 80 of the wall member 8 (FIG. 4) without damaging the connecting members 40-44.

It is preferable that a gasket or washer 51 may further be provided and engaged with or onto the connecting member 40-44 and engaged between the mold board 10, 11 and the peripheral flange 49 of the connecting member 40-44 (FIG. 1), and for suitably or sealingly engaged with the mold board 10, 11. As shown in FIG. 3, the connecting members 40-44 each may include an engaging hole or element 52-56 formed in the threaded end segment 47 for allowing the connecting members 40-44 to be rotated or driven by the other driving tools (not shown), and for allowing the connecting members 40-44 to be rotated or threaded onto the connection rod 30, and for allowing the connecting members 40-44 to be unthreaded or removed or disengaged from the hardened concrete material 80 of the wall member 8 (FIG. 4) when required.

For example, the connecting member 40 may include a slit-shaped engaging element 52 formed in the threaded end segment 47, the connecting member 41 may include a Phillip or cross-shaped engaging element 53 formed in the threaded end segment 47, the connecting member 42 may include a hexagonal-shaped engaging element 54 formed in the threaded end segment 47, the connecting member 43 may include a star-shaped engaging element 55 formed in the threaded end segment 47, and the other connecting member 44 may include a flat-shaped engaging element 56 formed in the threaded end segment 47 for engaging with various driving tools or screw drivers (not shown).

The fastener device 3 further includes two bracing rods or members 60, 61 engaged through the frame or angle members 12, 13; 14, 15 and each having a screw hole or inner thread 62 formed therein, such as formed in the inner end or one end portion 63 thereof for threading or engaging with the threaded end segments 47 of the connecting members 40-44 and for solidly and detachably attaching or mounting or securing to the end segments 47 of the connecting members 40-44 respectively. The bracing members 60, 61 each may further include a peripheral rib 64 extended radially and outwardly from the end portion 63 thereof for further contacting or engaging with the mold boards 10, 11 (FIG. 1), and for suitably anchoring or positioning or retaining the mold boards 10, 11 in place.

The bracing members 60, 61 each further include a cut off portion or flat surface or non-circular engaging member 65 formed or provided thereon for allowing the bracing members 60, 61 to be rotated relative to the connecting members 40-44 and to be rotated or driven by various driving tools (not shown), and each include an outer thread 66 formed on the other end or outer end portion 67 thereof for threading or engaging with a lock nut 69 or the like. Two washers or brackets or lock members 70, 71 may further be provided and each include an orifice 72 formed therein for receiving or engaging with the bracing members 60, 61 and for attaching or mounting to the bracing members 60, 61 and for allowing the brackets or lock members 70, 71 to be attached or mounted or contacted or engaged with the frame or angle members 12, 13; 14, 15 and for allowing the frame or angle members 12, 13; 14, 15 to be solidly anchored or positioned or secured or retained to the mold boards 10, 11.

In operation, as shown in FIG. 1, the mold boards 10, 11 may first be easily and quickly and solidly anchored or positioned or secured or retained together with the connecting members 40-44 and the connection rod 30 and the bracing members 60, 61, and the frame or angle members 12, 13; 14, 15 may then be easily and quickly and solidly anchored or positioned or secured or retained to the mold boards 10, 11 with the lock nuts 69 and the brackets or lock members 70, 71, the concrete material 80 may then be filled or introduced or engaged into the chamber 16 that is formed or defined between the mold boards 10, 11 for forming the concrete wall member 8 after the concrete material 80 is hardened. It is to be noted that the connecting members 40-44 may be used for coupling or connecting the connection rod 30 and the bracing members 60, 61 and for allowing the frame or angle members 12, 13; 14, 15 to be easily and quickly and solidly anchored or positioned or secured or retained to the mold boards 10, 11.

Alternatively, as shown in FIGS. 5-8, the connecting members 401, 411, 421, 431, 441 of different structure or configuration may be selected and each include one tilted or inclined end 451 having a screw hole or inner thread 46 formed therein for threading or engaging with the threaded end segments 31 of the connection rod 30, in which the tilted or inclined end 451 includes an outer diameter great enough to directly engage with the mold board 10, 11 without the peripheral flange 49, and the tilted or inclined end 451 is arranged to allow the connecting members 401, 411, 421, 431, 441 to be easily and suitably removed or disengaged from the concrete material 80 of the wall member 8.

Further alternatively, as shown in FIGS. 9-12, the connecting members 422, 432 of different structure or configuration may be selected and each include one tilted or inclined end 452 having a screw hole or inner thread 46 formed therein for threading or engaging with the threaded end segments 31 of the connection rod 30, and also for threading or engaging with the threaded end segments 622 of the bracing members 602, 612, and each also include a peripheral flange 49 extended radially and outwardly from each connecting member 422, 432 for contacting or engaging with the mold boards 10, 11, and each connecting member 422, 432 may include a hexagonal-shaped engaging element 542 or star-shaped engaging element 552 formed therein for engaging with various driving tools or screw drivers (not shown).

Figure 14:
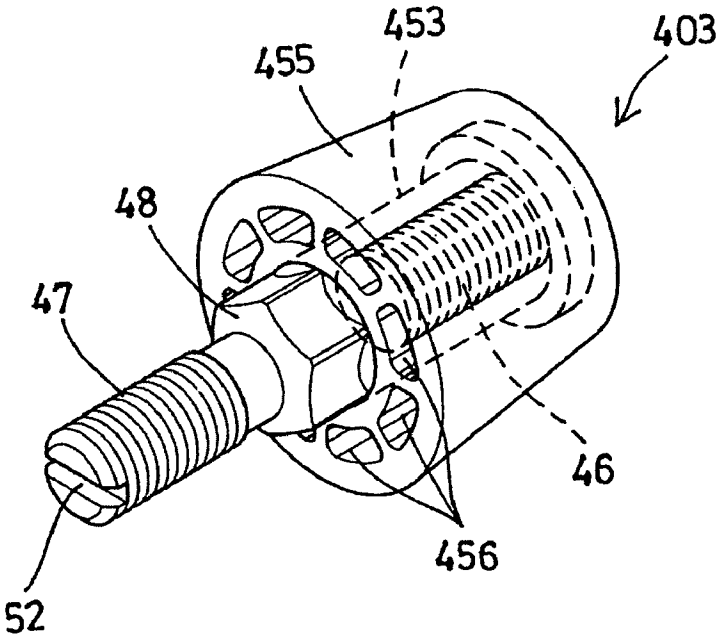
FIG. 14 is a perspective view illustrating the still further arrangement of the interconnection hardware or fastener device of the wall construction.
Figure 13:
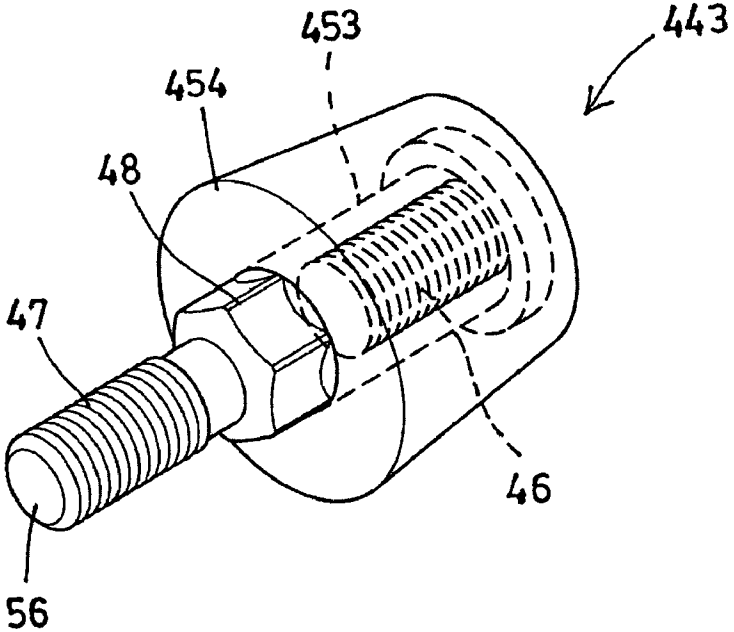
FIG. 13 is a perspective view illustrating the further arrangement of the interconnection hardware or fastener device of the wall construction.

Further alternatively, as shown in FIGS. 13-14, the connecting members 403, 443 of different structure or configuration may be selected and each include a planar or cylindrical end portion 453, and a tilted or inclined ferrule or barrel or sleeve 454, 455 attached or mounted or secured or engaged onto the cylindrical end portion 453, and having a screw hole or inner thread 46 formed therein for threading or engaging with the threaded end segments 31 of the connection rod 30, and the sleeve 455 of the connecting member 403 is preferably made of soft, plastic or resilient materials, and may include one or more longitudinal grooves 456 formed therein for increasing the resilience of the sleeve 455, and for allowing the connecting members 403, 443 to be easily and suitably removed or disengaged from the concrete material 80 of the wall member 8 when required.

Accordingly, the wall construction in accordance with the present invention includes a fastener device for easily and solidly securing mold boards together and for stably forming a concrete wall member without damaging the fastener device.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A wall construction comprising:

two mold boards spaced from each other for forming a chamber between said mold boards, said mold boards each including an opening formed therein, a connection rod disposed between said mold boards and including two end portions, two connecting members each including a first end attached to said end portions of said connection rod and engaged through said openings of said mold boards respectively, and said connecting members being engaged with said mold boards respectively for spacing said mold boards from each other and for positioning said mold boards in place relative to each other, and said connecting members each including a second end having an engaging element formed in said second end of said connecting member, and said connecting members each including a peripheral flange extended radially and outwardly therefrom and having an outer diameter greater than that of said connecting member for contacting and engaging with said mold boards respectively and for suitably blocking said openings of said mold boards respectively, and two bracing members attached to said second ends of said connecting members respectively and engaged with said mold boards respectively for further positioning said mold boards in place relative to each other.

2. The wall construction as claimed in claim 1 further comprising two frame members engaged with said mold boards respectively, said bracing members being engaged through said frame members and each including a lock member attached onto said bracing members and engaged with said frame members for positioning said frame members to said mold boards respectively.

3. The wall construction as claimed in claim 2, wherein said bracing members each include a lock nut engaged with said lock members for positioning said lock members and said frame members to said mold boards respectively.

4. The wall construction as claimed in claim 1, wherein said bracing members each include an engaging member provided thereon for being rotated relative to said connecting members.

5. The wall construction as claimed in claim 1, wherein said connecting members each include an outer thread formed on said second end of said connecting member, and said bracing members each include an inner thread formed in a first end portion thereof for threading and engaging with said outer thread of said connecting members and for securing to said connecting members respectively.

6. The wall construction as claimed in claim 1, wherein said connecting members each include a non-circular engaging member provided thereon for being rotated relative to said connection rod.

7. The wall construction as claimed in claim 1, wherein said connection rod includes an outer thread formed on each of said end portions thereof, and said connecting members each include an inner thread formed in said first end thereof for threading and engaging with said outer thread of said connecting rod.

8. The wall construction as claimed in claim 1, wherein said peripheral flanges of said connecting members each include an inclined outer peripheral portion.

* * * * *